US005992098A

United States Patent [19]

Flider et al.

[11] Patent Number: 5,992,098

[45] Date of Patent: Nov. 30, 1999

[54] SAFETY CABINET LATCHING SYSTEM

[75] Inventors: Frank S. Flider; Edward H. Witt, both of Mattoon, Ill.

[73] Assignee: Justrite Manufacturing Company, LLC, Des Plaines, Ill.

[21] Appl. No.: 09/208,222

[22] Filed: Dec. 9, 1998

[51] Int. Cl.[6] ..... E05C 7/04

[52] U.S. Cl. ..... 49/367

[58] Field of Search ..... 49/1, 7, 8, 366, 49/367, 141

[56] References Cited

U.S. PATENT DOCUMENTS 3,516,198 6/1970 Lyons ..... 49/1
3,830,016 8/1974 Levine ..... 49/8
4,517,765 5/1985 Mucha ..... 49/8 X

*Primary Examiner*—Jerry Redman
*Attorney, Agent, or Firm*—Trwin C. Alter

[57] ABSTRACT

A safety cabinet for the storage of flammable or combustible materials that has doors and a closure mechanism designed to automatically close and latch the doors in the event of fire. The closing mechanism is fully automatic and eliminates mechanical timing features as well as provides an automatic positive method and structure of closing the doors of the cabinet to insure a complete seal and lock. Furthermore, the latching assembly is operated using a handle which may be rotated into a tucked position. In this position, the handle rests in a cavity formed within the doors of the cabinet for protectively shielding the latching assembly to prevent accidental or unauthorized opening and handle breakage.

10 Claims, 5 Drawing Sheets

SAFETY CABINET LATCHING SYSTEM

The present invention relates generally to safety cabinets for flammable or explosive materials and, more particularly, to a safety cabinet having doors which automatically close and latch in response to a detected rise in the ambient temperature caused by fire. The invention also relates to the prevention of unwanted opening of the latch and cabinet doors.

In U.S. Pat. Nos. 4,262,448 and 4,619,076, the advantages of automatically closing safety cabinets were enumerated. By providing an automatically locking safety cabinet, the need for storing flammable liquids outside of the plant was obviated. Where a fireproof cabinet can be provided to insulate inflammable material from the direct effects of a fire, spreading the effects of the original fire can be prevented. However, as is explained, where a container of flammable liquid must be stored in a locked cabinet which must be unlocked each time the material is to be used, employees undoubtedly ignore the necessity for locking up such liquids in favor of the convenience and heightened productivity which result when the liquid is freely and readily available. Thus, as taught in the previous patents, a fireproof cabinet was provided that automatically closes and latches the cabinets in response to conditions of combustion to eliminate the need for concern over the necessity for locking up the cabinets.

Nonetheless, these devices are susceptible to accidental opening of the doors when the cabinet doors are latched but not locked. Moreover, even when the cabinet doors are latched and locked, the handle can be easily broken by forklifts or other heavy machinery operating in such work environments where a fireproof cabinet may be found. To protect against these occurrences, the present invention provides a handle that can rotate into a tucked position.

The tucked position of the handle serves many useful purposes. In view of the fact that the workers handling these volatile materials are reluctant to close and lock the cabinet doors in favor of heightened productivity, the handle mechanism in conjunction with the fireproof cabinet provide a simple and efficient way not only to latch the cabinet doors, but also to effectively fix the handle and latching mechanism in a latched position. This tucked position can therefore prevent accidental opening of the cabinet while not significantly hindering worker productivity. Furthermore, the tucked position guards against unwarrantedbreakage of the handle mechanism by machinery in the area.

Accordingly, the present invention has as one of its objects to not only provide fireproof cabinets having door closures which automatically close and latch responsive to conditions of combustion, but also to provide improved control over the latching mechanism such that accidental opening or breakage can be minimized.

These and further objects of the invention will become more readily apparent upon consideration of the accompanying drawings wherein like characters of reference indicate corresponding parts:

Figure 11:
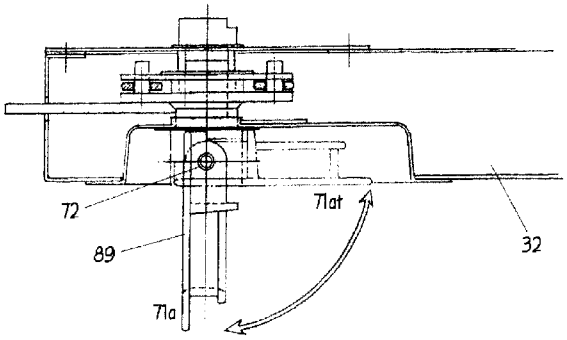
Figure 10:
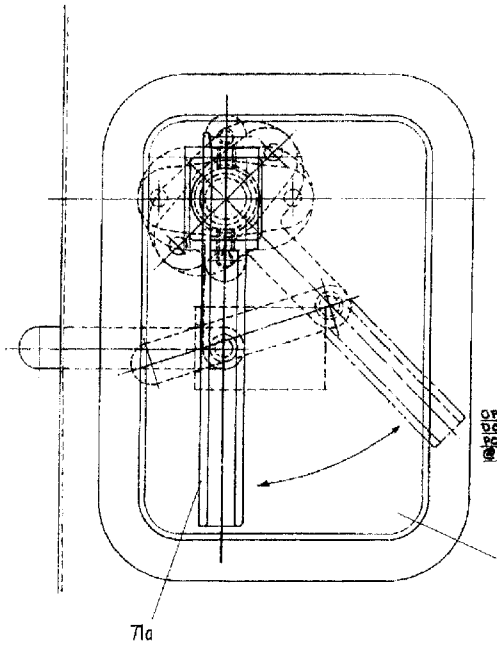
Figure 12:
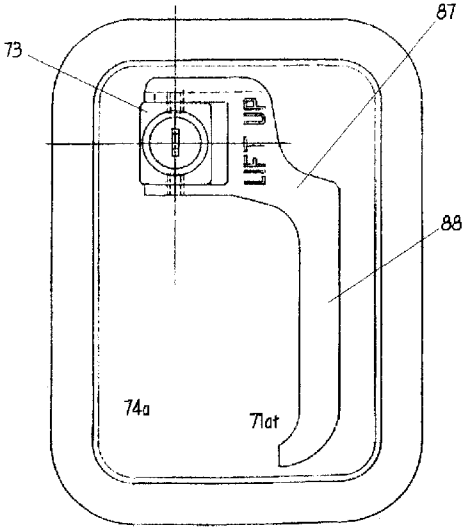

FIGS. 10–12 display a front view, a top view, and a front view for the tucked position, respectively, of an alternate embodiment of the handle mechanism.

Figure 1:
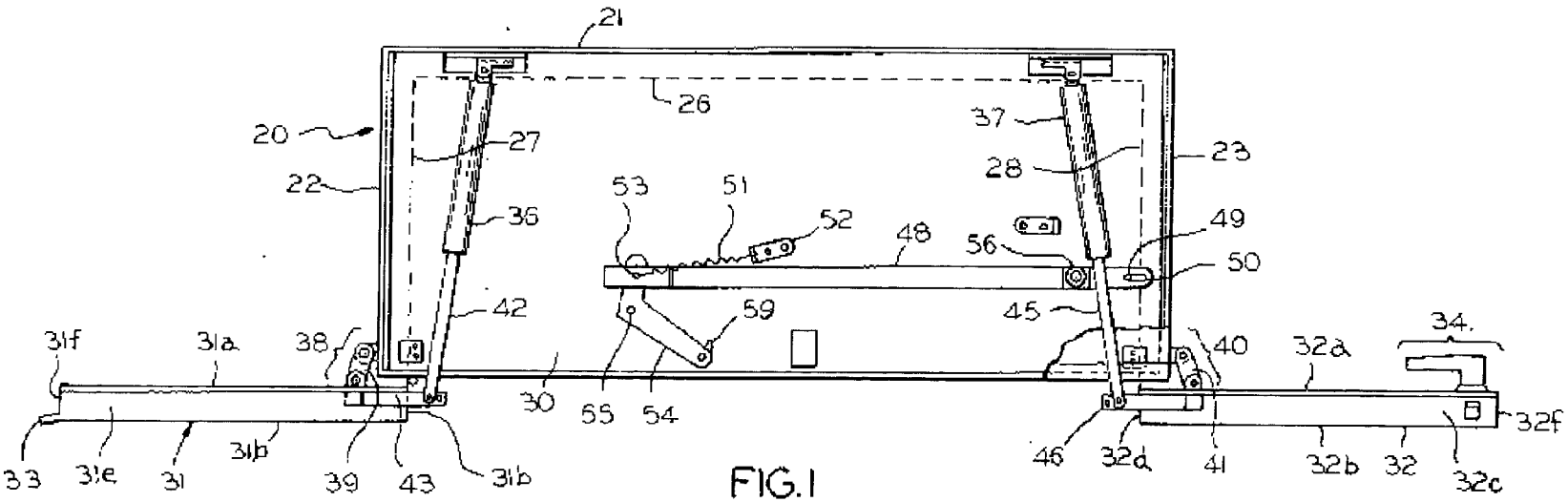
FIG. 1 is a top view of a fireproof cabinet and automatic door closure.
Figure 3:
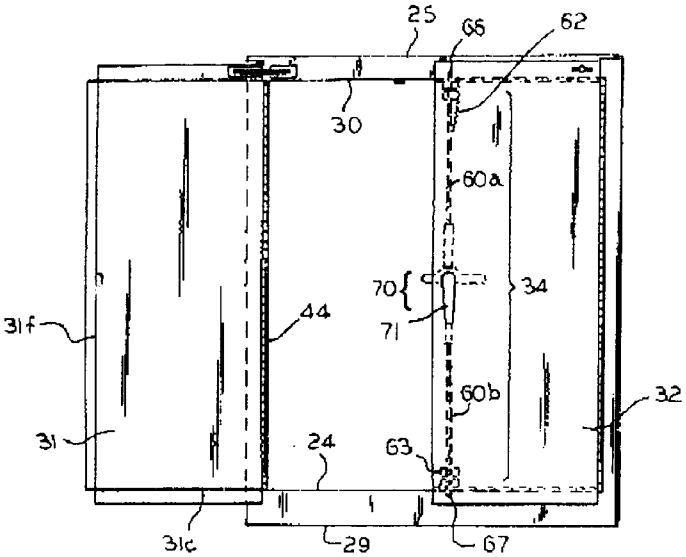
FIG. 3 is a front elevational view of a cabinet showing the operation of the latch in phantom.

Referring now to FIG. 1, the numeral 20 indicates generally a fireproof cabinet assembly having an outer rear wall 21, an outer left side wall 22, an outer right side wall 23, and an inner floor 24. As best seen in FIG. 3, cabinet 20 also has a top having an outer top wall 25.

In keeping with one preferred construction of fireproof cabinets, cabinet 20 is a double-walled construction, wherein each said wall has a corresponding inner wall, with said inner and outer walls separated by a dead air space. Thus, in FIG. 1, outer rear wall 21 has a corresponding inner rear wall 26, outer left side wall 22 and outer right side wall 23 have corresponding inner walls 27 and 28, respectively, while as best seen in FIG. 3, inner floor 24 has corresponding outer wall 29, and outer top 25 has a corresponding inner top wall 30.

Figure 2:
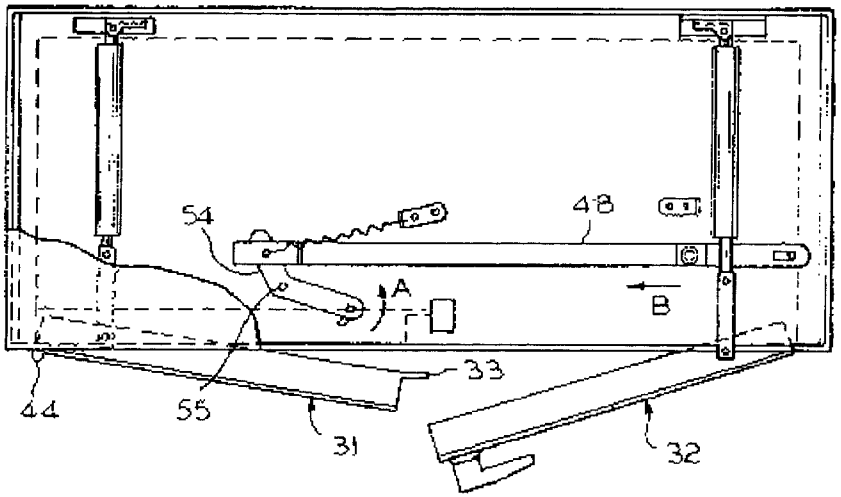
FIG. 2 shows the device of FIG. 1 with the doors partially closed.

As best seen in FIGS. 1 and 2, the front of cabinet 20 is selectively closed off by a pair of doors, with left hand door 31 having a similar double wall construction, with outer door front 31a spaced apart from inner door front 31*b*, by side walls 31*c*, 31*d*, 31*e* and 31*f* defining an enclosed dead air space. Right hand door 32 is of similar construction, with side walls 32*c*, 32*d*, 32*e* and 32*f* joining outer door front 32*a* and inner door front 32*b*.

Figure 5:
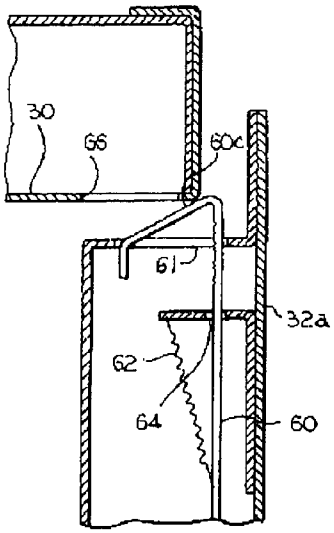
FIG. 5 is a view of the assembly in FIG. 4 showing the door open and moving to a closed position.
Figure 4:
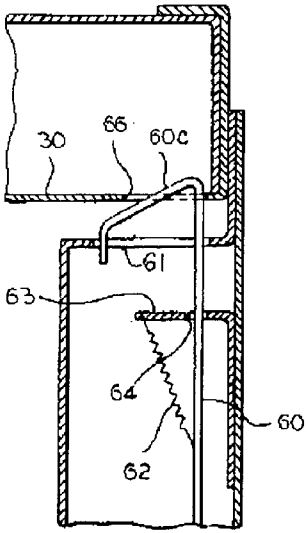
FIG. 4 is a partial sectional view illustrating the automatic latching mechanism in a closed position.

In the embodiment illustrated in FIGS. 1 and 2, left hand door 31 has an extended sealing lip 33 protruding along side wall 31*f*. Right hand door 32 has a latching mechanism generally indicated at 34 with which said cabinet may be selectively latched in a manner to be described more fully hereinbelow. As best seen in FIGS. 3, 4 and 5, outer door wall 32*a* overlaps the opening of cabinet 20 along the top and bottom, as does outer door wall 31*a*.

Thus, when doors 31 and 32 are closed, cabinet 20 defines an inner protected air space surrounded on the top, bottom, sides, back and front by double-walled elements having insulating air spaces created therebetween. Thus articles placed within cabinet 20 are protected from the effects of fire when said doors 31 and 32 are closed and latched.

In a preferred embodiment of the present invention, doors 31 and 32 can remain in an open position, with means provided to automatically close and latch said doors in the event of fire. In the preferred embodiment illustrated in FIGS. 1 and 2, left door 31 is urged to a closed position by, for example, air cylinder 36, while right door 32 is similarly urged to a closed position by air cylinder 37.

Retaining means are provided to retain left door 31 in an open position, such as illustrated at 38. In a preferred embodiment, said retaining means 38 includes a fusible link 39 which, at a preselected ambient temperature, fuses or melts, thus releasing left door 31 and enabling cylinder 36 to pull said door into a closed position.

A similar retaining element 40 is used to hold right door 32 in an open position, and fusible link 41 similarly provides means to release right door 32 in the event of a rise in ambient temperature.

As best seen in FIG. 1, shaft 42 of air cylinder 36 is attached to left door link 43 which, in turn, is attached to outer door wall 31*a* of left door 31. As best seen in FIG. 3, left door 11 is preferably hinged to cabinet 20 by hinge 44 which extends substantially the full height of left door 31. A similar arrangement is contemplated for right door 32, whereby shaft 45 of air cylinder 37 is pivotally attached to right door link 46. Right door 32, in turn, is hinged upon hinge 47 which, again, extends substantially the full height of right door 32.

As best seen in FIG. 2, when left door 31 is closed, right door 32 may then be closed to engage sealing lip 33. Thus, during any automatic closing of doors 31 and 32, it is necessary that said doors close in sequence wherein left door 31 reaches a closed position prior to right door 32. This sequence must be maintained regardless of the sequence in which fusible links 39 and 41 melt.

A preferred embodiment to time the closing of doors 31 and 32 includes a timing slide bracket 48 which is positioned between top wall 30 and outer top wall 25 of cabinet 20. Timing slide bracket 48 is slidably mounted upon slide pivot stud 49, and may be moved left or right, limited by the dimensions of slot 50, formed in timing slide bracket 48 through which slide pivot stud 49 protrudes. Slide bracket spring 51 is attached to spring anchor 52, and at its other end, to timing slide bracket 48 at 53. Thus, timing slide bracket 48 is normally urged to a full righthand position, with slide pivot stud 49 positioned at the leftmost extreme of slot 50.

Actuating plate 54 is pivotally mounted to inner top wall 30 by actuating stud 55, and is pivotally attached to timing slide bracket 48 at 53. As seen in FIG. 1, actuating arm 54 has actuating stud 55 positioned in arcuate slot 59 formed in wall 30. Thus, rotation of actuation plate 54 about actuating stud 55 is limited and guided by slot 57.

As best seen in FIG. 2, when actuating plate 54 is moved in the direction indicated by A, timing slide bracket 48 is pulled in a leftward direction B.

When doors 31 and 32 to cabinet 20 are held open, and timing slide bracket 48 is positioned in its rightward most attitude, and stop roller stud 56 is positioned as shown in FIG. 1. Stop roller stud 56 will contact right door link 46 as right door 32 closes responsive to the release of door 32 by the fusing of fusible link 41 in retaining assembly 40. In this manner, the closing of door 32 will be arrested by stop roller stud 56.

As best illustrated in FIG. 2, door 32 will remain partially open until timing slide bracket 48 moves leftward a sufficient distance to position stop roller stud 56 out of the path of door bracket 46.

Movement of timing slide bracket 48 is accomplished as follows. When fusible link 39 has released door 31, said door 31 is drawn closed by air cylinder closure 36 about hinge 44 until inner door wall 31*b* contacts actuating plate 54. Sufficient force is thus exerted on actuating plate 54 to pivot it about actuating stud 55 thereby drawing timing slide bracket 48 leftward, in direction B, (FIG. 2) moving stud 56 and allowing door 32 to complete its closing movement. In this manner, it is assured that door 31, with sealing lip 33, will close fully before door 32, thus providing a protective seal.

Once closed, doors 31 and 32 must remain closed for maximum safety. To provide automatic latching capability, a latching mechanism 34 is provided as seen in FIG. 3.

Latching mechanism 34 includes latch rod 60 having an upper inclined end 60*c* that is actuated upward out of the door opening 61 by spring means 62 attached to a latch guide bracket 63, as seen in FIGS. 3 and 4, within which latch rod 60 is maintained. Each such latch bracket 63 has an oval slot 64 formed therein, enabling latch rod 60 to be moved slightly in a horizontal direction.

As seen in FIGS. 4 and 5, upper latch bracket 63 is attached to the inner side of outer door wall 32*a*.

In a preferred embodiment, latch rod 60 includes an upper latch rod segment 60*a* and a lower latch rod segment 60*b*, as best seen in FIG. 3. When the latching mechanism 34 is in an unlatched position, handle 71 of the handle mechanism 70 is held horizontally, as seen in phantom in FIG. 3. Upper and lower latch rod segments 60*a* and 60*b* are pivotally attached to the handle mechanism 70 in any conventionally known manner such that in an unlatched position, upper latch rod segment 60*a* is drawn downward and lower latch rod segment 60*b* is drawn upward.

As best seen in FIGS. 4 and 5, inner top wall 30 has upper latch aperture 66 formed therethrough to register with the inclined end 60*c* of latch rod 60 when door 32 is closed. As seen from FIGS. 4 and 5, this inclined end does not protrude through the aperture unless the door is in its closed position. The straight portion 60 depending from the inclined end is slidably associated with the top wall opening so it causes the door to remain closed unless the inclined end is withdrawn from the opening by sliding the depending straight portion. A similar aperture is formed through inner floor 24, as indicated in FIG. 3. Thus, in its unlatched position, upper latch rod 60*a* is withdrawn from upper latch aperture 66, and lower latch rod segment 60*b* is withdrawn from lower latch aperture 67.

In a preferred embodiment, latch rod segments 60*a* and 60*b* are normally in a latched position due to the urging of spring 62 forcing the inclined ends 60*c* outward of the latch aperture 66. Thus the only time it is in an unlatched position is when the door is opened or closed due to the inclined end being forced downward inside the door.

As seen in FIGS. 4 and 5, when door 32 is completely closed, the latch rod 60*a* is in its outward position with its inclined end 60*c* protruding through the upper ledge aperture 66 of the inner top wall 30 and is held in such position by means of the spring 62. The automatic upward movement of latch rod segment 60*a* and corresponding lower movement of latch rod 60*b* no longer depends on a releasing shoulder but rather on the inclined end 60*c* of the latching rod being gradually depressed and eased into registry by means of the inclined surface of the inclined end 60*c*. Automatic upward movement of latch rod segment 60*a* and the corresponding lower movement of the latch rod 60*b* is still caused by latch rod spring 62 providing such stress that the rotation of the handle 71 to an unlatched position stresses spring 62. When the straight latch rod 60 is moved, the inclined end 60*c* is caused to protrude through the upper latch aperture 66, and the handle 71 is rotated to its closed position. However, when it is desired to open the door, the handle 71 is rotated to its open position, thereby enabling the inclined end 60*c* to be withdrawn into the door for clearance. Once the doors are open, the inclined ends are slid through the opening in the door so that they appear as pictured in FIG. 5 in the 'closing' position.

As described above, control of the latching mechanism 34 is exerted by the handle mechanism 70, which is further illustrated in FIGS. 6, 7, 8 and 9. Referring to these figures, the handle 71 is in an open position when horizontal, corresponding to the unlatched position of latching mechanism 34. Likewise, the handle 71 is in a closed position when vertical, corresponding to the latched position of latching mechanism 34 when the doors are closed. It must be noted that when the cabinet doors are shut (either automatically or manually), regardless of the initial position of the handle 71, the latching mechanism 34 will engage the top wall 30 and inner floor 24 of the cabinet 20, resulting in a latched position.

Figure 9:
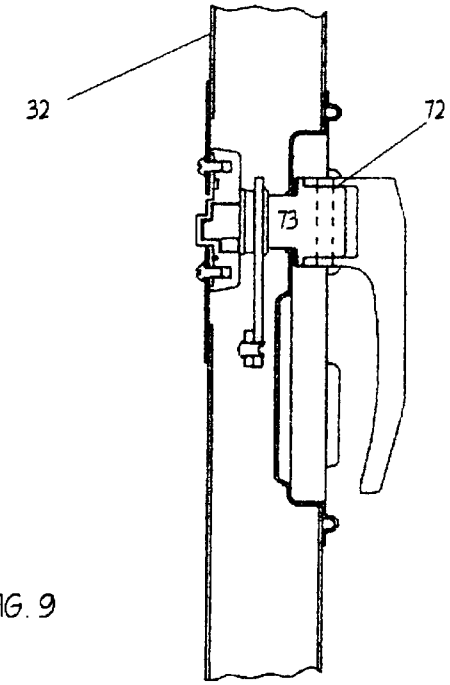
FIG. 9 is a side view of the handle mechanism shown in FIGS. 7 and 8.
Figure 8:
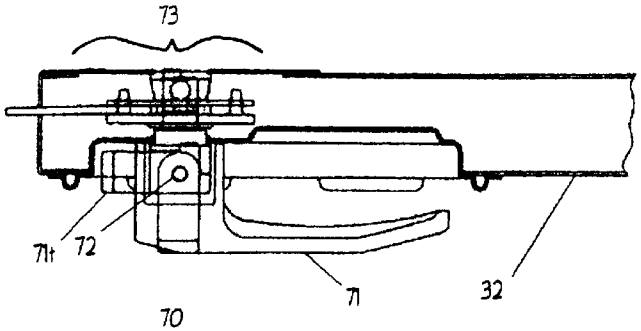
FIG. 8 is a top view of the handle mechanism shown in FIG. 7.

Referring to FIGS. 8 and 9, the handle mechanism 70 has a handle 71 that is pivotally attached to a lock tumbler assembly 73 via pin 72. Lock tumbler assembly 73 is rotatably attached to latch rod segments 60*a* and 60*b* which are shown in FIG. 3. Thus, an operator controls the latching mechanism 34 through handle 71 of the handle mechanism 70.

Figure 7:
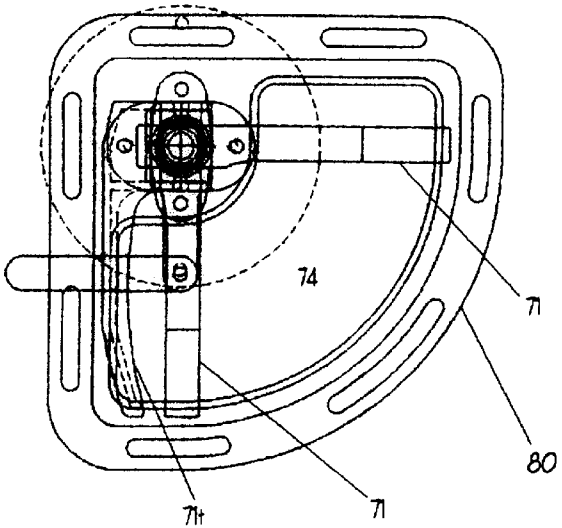
FIG. 7 is a front view of the handle mechanism.

As shown in FIG. 7, the lock tumbler assembly 73 is generally hidden from view by handle 71. However, as best shown in FIG. 8, handle 71 may be pivoted in a clockwise motion around an axis represented by pin 72, thereby revealing the lock tumbler assembly 73. Upon rotation, the handle 71 is substantially contained in a cavity 74 formed within door 32 by handle housing 80. This 'tucked' position 71*t* of the handle 71 precludes using the handle mechanism 70 to operate the latching mechanism 34, as described in more detail below. With the lock tumbler assembly 73 exposed, a key means or other means may be used to lock/unlock the doors 31 and 32.

Figure 6:
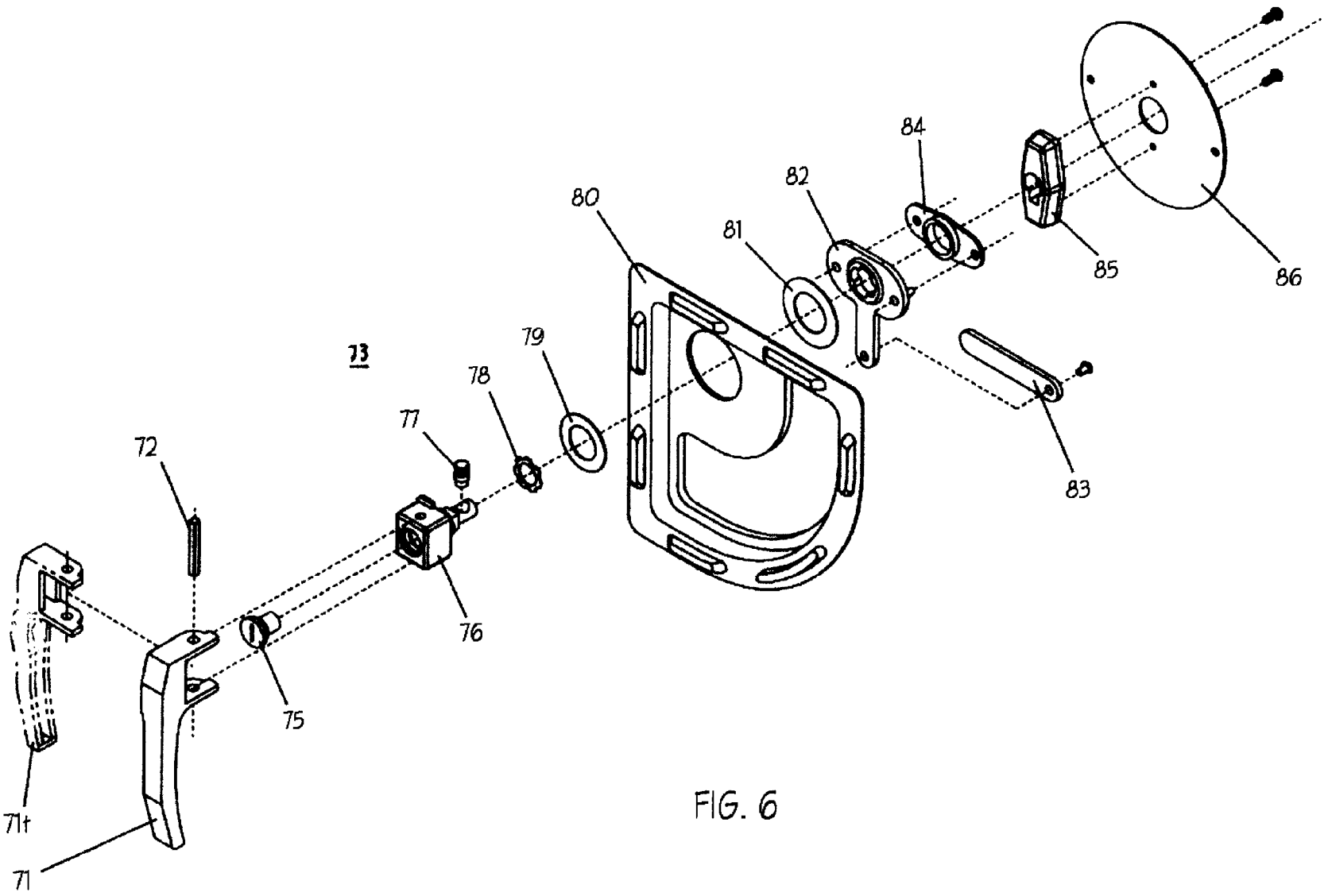
FIG. 6 is an exploded isometric view of the handle mechanism.

FIG. 6 shows an exploded view of the handle mechanism 70. Lock tumbler assembly 73 is represented here by numerals 75 to 86. Handle 71 is rotatably fixed to the lock tumbler housing 76 with pin 72. Lock tumbler face 75 is received by lock tumbler housing 76, and the opposing male end of lock tumbler housing 76 extends through lock nut 78 and washer 79 which comes into contact with the front of handle housing 80. Continuing from the opposite side of handle housing 80, the male end of lock tumbler housing 76 extends through washer 81, cam lever 82, latch rod retainer 84 and finally into lock alignment retainer 85. Access plate 86 is fixed to lock alignment retainer 85 and is fixed to and flush with inner door front 32*b*. Lock tumbler bolt 77 extends downward through the male end of lock tumbler housing 76. Latch tongue 83 is fixed to cam lever 82.

Lock alignment retainer 85 restricts the rotational movement of the lock tumbler assembly 73 in its resting state, and upon withdrawal of the male end of the lock tumbler housing 76 and lock tumbler bolt 77, the lock tumbler assembly is free to rotate. Thus, the tucked position 71*t* of the handle 71 provides a preventative form of locking means since it is only when the handle 71 is in its untucked position can the lock tumbler housing 76 and lock tumbler bolt 77 be withdrawn to unlatch the latching mechanism 34. Additionally, the use of a key or other means to operate lock tumbler assembly 73 controls the rotation of the cam lever 82 and hence the latch tongue 83, thereby locking or unlocking the cabinet based upon the position of the latch tongue 83.

FIGS. 10–12 show an alternate embodiment of the handle mechanism 70. A handle 71*a* is rotatably fixed to the lock tumbler housing 76 with pin 72. Likewise, the handle 71*a* is in a closed position when vertical. However, unlike the previous embodiment, the handle 71*a* is in an open position when rotated approximately 45 degrees counterclockwise, as shown in FIG. 10, corresponding to the unlatched position of latching mechanism 34. Further, and as best seen in FIG. 12, handle 71*a* comprises a contoured first portion 87 extending downward and away from the lock tumbler assembly 73, and a second portion 88 extending downward. The handle 71*a*, when un-tucked, extends away from the cabinet 20 such that cavity 74*a* needs only to accommodate the handle 71*a* in its tucked position 71*at*, described below.

As best seen in FIG. 11, the handle 71*a* moves into its tucked position 71*at* by rotating counterclockwise around the axis represented by pin 72. Upon rotation, the handle 71*a* is contained in a cavity 74*a* formed within door 32. The tucked position 71*at* of the handle 71*a* precludes its use to operate the latching mechanism 34, as described above. By rotating the handle 71*a* away from door 31, as opposed to rotating the handle 71 towards the door 31, the cavity 74*a* need not be as wide as cavity 74, and the latching mechanism 34 may be located closer to the door 31 and the end of door 32.

Further, and as best seen in FIG. 11, an elongated face 89 comprises the side of handle 71*a* which faces outward from the cabinet 20 in the tucked position 71*at*. The elongated face 89 permits human hands to easily rotate the handle 71*a* out of the tucked position 71*at*, despite the smaller size of the cavity 74*a*. Similarly, the smaller cavity 74*a* and the elongated face 89 decrease the likelihood of unwanted un-tucking.

Thus, permitting a tucked position for the handle 71 in conjunction with cabinet 20 provides a simple and efficient way not only to latch the cabinet doors 31 and 32 both automatically and manually, but to also effectively fix the latching mechanism 34 in a latched position. The tucked position can therefore prevent accidental opening of the cabinet 20 while not significantly hindering worker productivity. Furthermore, the tucked position guards against unwarrantedbreakage of the handle mechanism 70 by machinery in the area.

While the foregoing has presented specific embodiments of the invention herein, it is to be understood that these embodiments are presented by way of example only. It is expected that others skilled in the art will perceive variations which, while differing from the foregoing, do not depart from the spirit and scope of the invention as herein described and claimed.

What is claimed is:

1. A closure mechanism which insures a sealing and locking that prevents accidental or unauthorized opening of a cabinet in its locked position, the cabinet having first and second rotating doors;

closing means to urge the first and second doors to a closed position;

timing means mounted to the interior of the cabinet to control the closing sequence of the first and second doors;

means to prop the first and second doors in an open position, the prop means including link means pivotally mounted to each of the doors;

the link means being fashioned from heat fusible material whereby a selected rise in ambient temperature will fuse the link thereby releasing the door from its open position and allowing the door to close when the timing means releases the door for rotation to a closed position;

latching means to latch the doors in a closed position responsive to the closing of the first and second doors, the latching means having a latching rod that includes an inclined outer end which forms an acute angle with an inner portion of the latching rod, the latching rod being spring biased outwardly to urge the inclined outer end out of an opening in the first door into engagement with the cabinet by having the outer inclined end protrude through an opening in the wall of the cabinet;

the latching means being operatively connected to said closure mechanism, said closure mechanism comprising:

a cavity means;

a handle mechanism operatively connected to the latching means to control the operation of the latching means, said handle mechanism having a handle that is rotatable into said cavity thereby shielding said handle mechanism and precluding the operation of the latching means.

2. A closure mechanism, as defined in claim 1, wherein said handle mechanism has locking means, said locking means operated by a rotatable tumbler, prohibiting the accidental opening of the cabinet, whereby the cabinet can be secured from unauthorized entry.

3. A closure mechanism, as defined in claim 2, wherein said handle mechanism rotates away from the second door into said cavity.

4. A closure mechanism, as defined in claim 2, wherein said handle mechanism rotates towards the second door into said cavity.

5. A closure mechanism, as defined in claim 2, wherein said handle mechanism, when said locking means is in its unlocked position, allows selective closing and latching of the first and second doors by merely pushing the doors closed when it is desired to close them, and wherein said handle mechanism allows selective opening and unlatching of the first and second doors by turning said handle mechanism, whereby the inclined outer end of the latching rod enables the doors to open and close based on whether or not the inclined outer end is protruding through the cabinet door.

6. A closure mechanism, as defined in claim 1, wherein said handle mechanism rotates towards the second door into said cavity.

7. A closure mechanism, as defined in claim 1, wherein said handle mechanism rotates towards the second door into said cavity.

8. A closure mechanism, as defined in claim 1, wherein the inclined outer end is slanted in a direction that enables the inclined end only to protrude through the cabinet wall opening when the first door is in its closed position.

9. A closure mechanism, as defined in claim 8, wherein the inclined end is operatively associated with said handle mechanism and can cause the inclined end to be withdrawn from the cabinet wall opening when said locking means is unlocked and said handle mechanism can have its handle rotate to cause the inclined end to be withdrawn from the cabinet wall opening to enable the first and second rotating doors to be opened.

10. A closure mechanism, as defined in claim 9, wherein the inclined outer end has a straight portion depending downward therefrom, said straight portion being slidably associated with a side of the cabinet wall opening as well as a side of the first door opening, whereby said straight portion causes the first door to remain closed until the latching means is rotated to withdraw the inclined outer end.

* * * * *